US007636991B1

(12) United States Patent
Scalisi, III

(10) Patent No.: US 7,636,991 B1
(45) Date of Patent: Dec. 29, 2009

(54) GREEN BURIAL SYSTEM

(76) Inventor: Charles Scalisi, III, 16111 Winding Water Dr., Odessa, FL (US) 33556

( * ) Notice: Subject to any disclaimer, the term of this patent is extended or adjusted under 35 U.S.C. 154(b) by 0 days.

(21) Appl. No.: 12/287,969

(22) Filed: Oct. 14, 2008

(51) Int. Cl.
*A61G 17/00* (2006.01)

(52) U.S. Cl. ..... 27/1; 27/35; 52/133; 52/136

(58) Field of Classification Search ..... 27/35, 27/29, 2, 1; 52/136, 133, 128, 103, 104; 40/124.5; 324/326
See application file for complete search history.

(56) References Cited

U.S. PATENT DOCUMENTS

| | | | | | |
|---|---|---|---|---|---|
| 834,204 | A * | 10/1906 | Hodges | 52/137 |
| 1,964,234 | A * | 6/1934 | Vogel | 52/141 |
| 3,596,419 | A * | 8/1971 | Jalbert | 52/137 |
| 3,772,826 | A * | 11/1973 | Ferver | 47/66.6 |
| 3,898,718 | A * | 8/1975 | Eubank | 27/35 |
| 4,977,652 | A * | 12/1990 | Graham | 27/1 |
| 5,239,733 | A * | 8/1993 | Vail et al. | 27/1 |
| 5,701,642 | A * | 12/1997 | Order | 27/4 |
| 5,987,720 | A * | 11/1999 | Yamamoto | 27/35 |
| 7,093,396 | B2 * | 8/2006 | Pazar | 52/128 |
| 7,458,138 | B2 * | 12/2008 | Spiers et al. | 27/29 |
| 7,478,461 | B2 * | 1/2009 | Glass | 27/1 |
| 2002/0026455 | A1 * | 2/2002 | Toothman et al. | 707/204 |

* cited by examiner

*Primary Examiner*—William L. Miller

(57) ABSTRACT

A single grave site has upper and lower regions with a divider between the regions. A biodegradable primary container encompasses a primary remains in the lower region in closely spaced proximity to the divider. An electronic information assembly in the grave site is adjacent to the divider. The upper region is adapted to receive at least one additional biodegradable container.

8 Claims, 2 Drawing Sheets

FIG 1
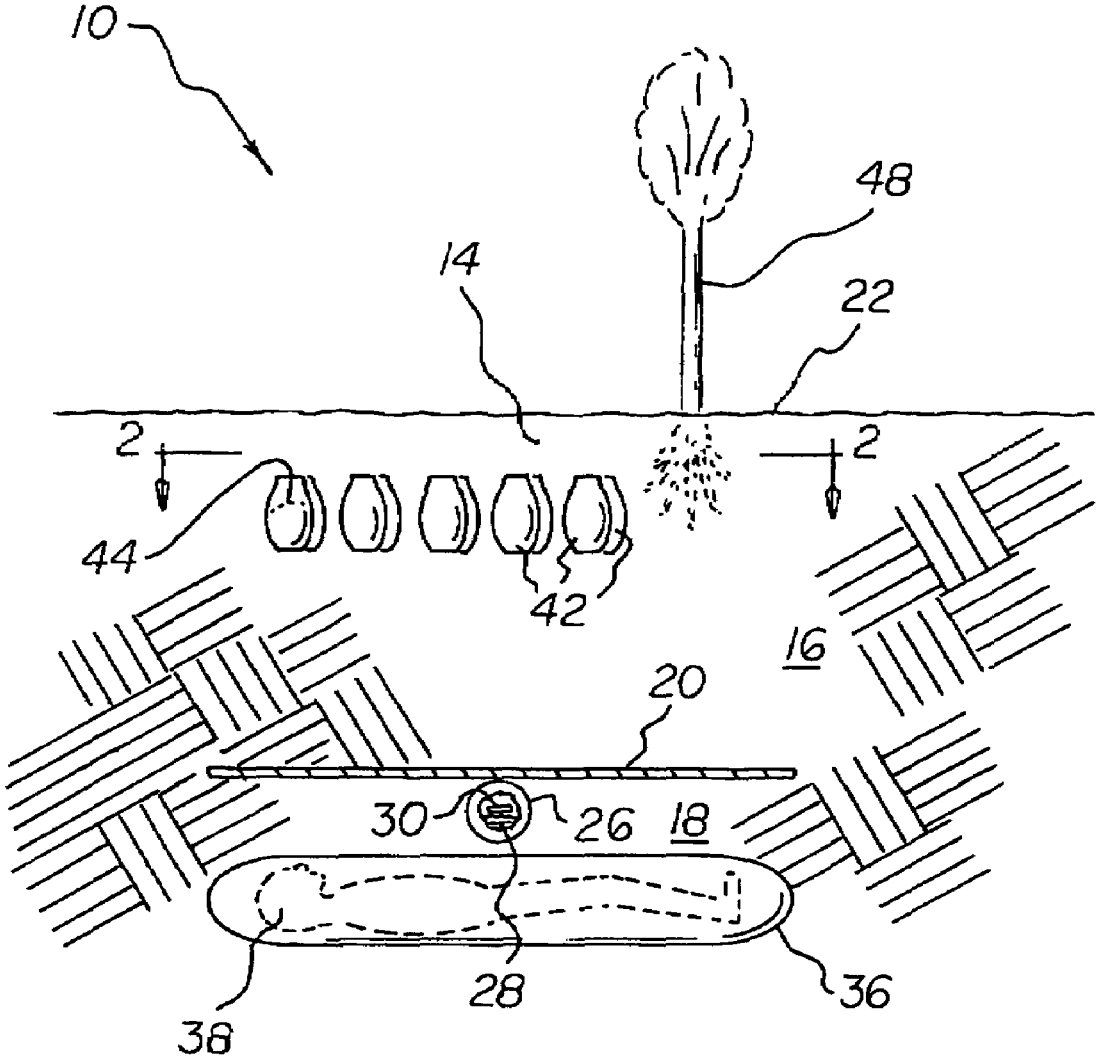
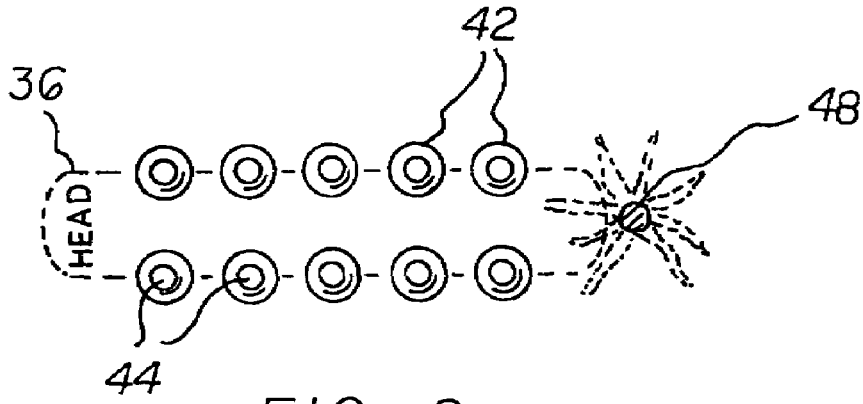
FIG 2

GREEN BURIAL SYSTEM

BACKGROUND OF THE INVENTION

1. Field of the Invention

The present invention relates to a green burial system and more particularly pertains to burying plural remains in a single grave site in an ecological, respectful and economical manner.

2. Description of the Prior Art

The use of burial systems of known designs and configurations is known in the prior art. More specifically, burial systems of known designs and configurations previously devised and utilized for the purpose of burying human remains are known to consist basically of familiar, expected, and obvious structural configurations, notwithstanding the myriad of designs encompassed by the crowded prior art which has been developed for the fulfillment of countless objectives and requirements.

While the burial systems of known designs and configurations fulfill their respective, particular objectives and requirements, the aforementioned patents do not describe a green burial system that allows for burying plural remains in a single grave site in an ecological, respectful and economical manner.

In this respect, the green burial system according to the present invention substantially departs from the conventional concepts and designs of the prior art, and in doing so provides an apparatus primarily developed for the purpose of burying plural remains in a single grave site in an ecological, respectful and economical manner.

Therefore, it can be appreciated that there exists a continuing need for a new and improved green burial system which can be used for burying plural remains in a single grave site in an ecological, respectful and economical manner. In this regard, the present invention substantially fulfills this need.

SUMMARY OF THE INVENTION

In view of the foregoing disadvantages inherent in the known types of burial systems of known designs and configurations now present in the prior art, the present invention provides an improved green burial system. As such, the general purpose of the present invention, which will be described subsequently in greater detail, is to provide a new and improved green burial system and method which has all the advantages of the prior art and none of the disadvantages.

To attain this, the present invention essentially comprises a green burial system for burying plural remains in a single grave site. The burying is in an ecological, respectful and economic manner. The system is comprised of a plurality of components. Such components in their broadest context include a single grave site with an upper region and a lower region, biodegradable primary containers, and an electronic information assembly. Such components are individually configured and correlated with respect to each other so as to attain the desired objective.

First provided is a single grave site having dirt. The single grave site includes an upper region and a lower region. A non-biodegradable divider between the upper and lower regions, the grave site having a generally horizontal ground level above with the divider being generally horizontal at approximately 6 feet below ground level.

An electronic information assembly is next provided. The electronic information assembly includes a non-biodegradable sphere with a hollow interior. The hollow interior includes water and an electronic chip. The chip has digital information pertaining to the location of the grave site and the contents of the grave site. The chip has a specific gravity less than water. The chip will, therefore, float on the water and remain horizontal at all times for more accurate readings even following a shift of the earth. The sphere is positioned adjacent to the lower region closely spaced from the divider. An operator controlled detector is adapted to convert the chip from a passive quiescent state to an active disseminating state for allowing a user to read and display the digital location and contents information.

A biodegradable primary container is next provided. The primary container encompasses a primary remains. The primary container is a primary shroud. The primary container and the primary remains are positioned in a generally horizontal orientation in the lower region of the grave site in closely space proximity to the divider.

Next provided is a plurality of biodegradable urns. Ashes of a single remains are in each urn. The urns are aligned in columns of multiple rows in the upper region. The urns are in a common horizontal plane closer to the ground level than to the divider.

Lastly, a tree may be optionally provided. The tree is optionally planted on the grave site with roots within the upper region reaching grave sites below.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved green burial system which has all of the advantages of burial systems of known designs and configurations and none of the disadvantages.

It is another object of the present invention to provide a new and improved green burial system which may be easily and efficiently manufactured and marketed.

It is a further object of the present invention to provide a new and improved green burial system which is of dependable and reliable constructions.

An even further object of the present invention is to provide a new and improved green burial system which is susceptible of a low cost of manufacture with regard to both materials and labor, and which accordingly is then susceptible of low prices of sale to the consuming public, thereby making such green burial system economically available to the buying public.

Even still another object of the present invention is to provide a green burial system for burying plural remains in a single grave site in an ecological, respectful and economical manner.

Lastly, it is an object of the present invention to provide a new and improved green burial system having a single grave site with upper and lower regions with a divider between the regions, a biodegradable primary container encompassing a primary remains in the lower region in closely spaced proximity to the divider, and an electronic information assembly in the grave site adjacent to the divider, and wherein the upper region is adapted to receive at least one additional biodegradable container.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiment and alternate embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a green burial system constructed in accordance with the principles of the present invention.

FIG. 2 is a plan view of the green burial system taken along line 2-2 of FIG. 1.

The same reference numerals refer to the same parts throughout the various Figures.

DESCRIPTION OF THE PREFERRED EMBODIMENT

Figure 3:
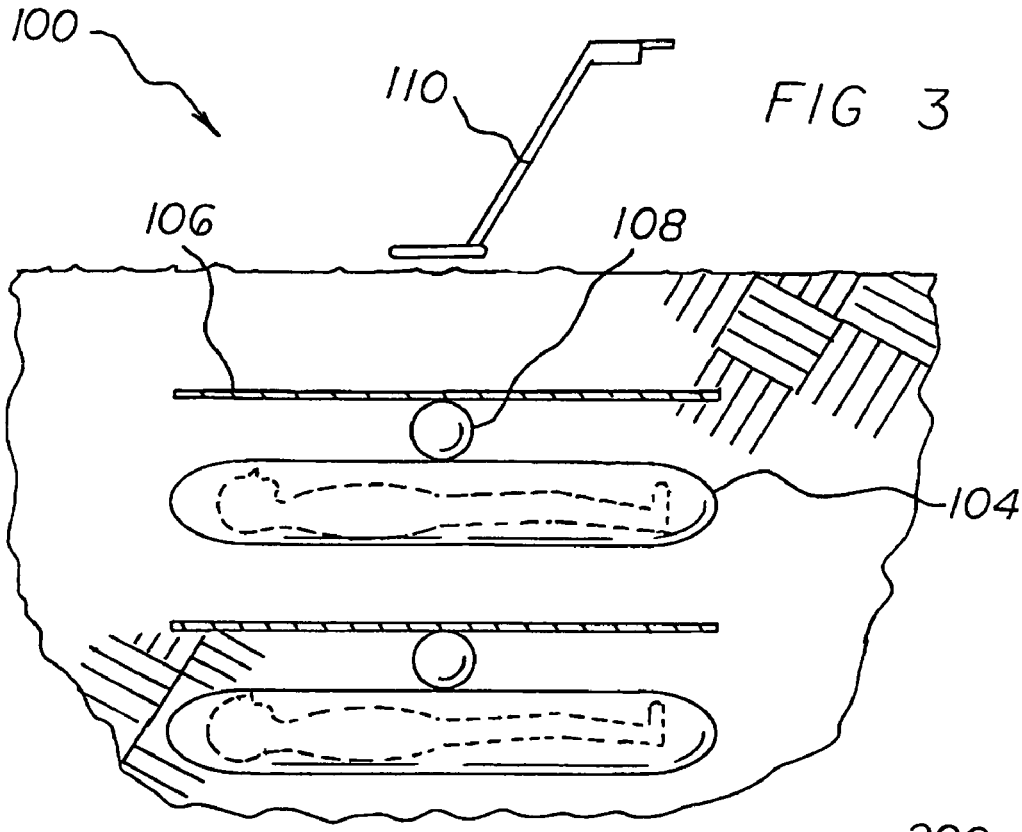
FIGS. 3 and 4 are side elevational views of green burial systems constructed in accordance with alternate embodiments of the invention.

With reference now to the drawings, and in particular to FIG. 1 thereof, the preferred embodiment of the new and improved green burial system embodying the principles and concepts of the present invention and generally designated by the reference numeral 10 will be described.

The present invention, the green burial system 10 for burying plural remains in a single grave site, the burying being done in an ecological, respectful and economic manner is comprised of a plurality of components. Such components in their broadest context include a single grave site with an upper region and a lower region, biodegradable primary containers, and an electronic information assembly. Such components are individually configured and correlated with respect to each other so as to attain the desired objective.

First provided is a single grave site 14 having dirt. The single grave site includes an upper region 16 and a lower region 18. A non-biodegradable divider 20 between the upper and lower regions, the grave site having a generally horizontal ground level 22 above with the divider being generally horizontal at approximately 6 feet below ground level;

An electronic information assembly is next provided. The electronic information assembly includes a non-biodegradable sphere 26 with a hollow interior. The hollow interior includes water 28 and an electronic chip 30. The chip has digital information pertaining to the location of the grave site and the contents of the grave site. The chip has a specific gravity less than water. The chip will, therefore, float on the water and remain horizontal at all times for more accurate readings even following a shift of the earth. The sphere is positioned adjacent to the lower region closely spaced from the divider. An operator controlled detector is adapted to convert the chip from a passive quiescent state to an active disseminating state for allowing a user to read and display the digital location and contents information.

A biodegradable primary container 36 is next provided. The primary container encompasses a primary remains 38. The primary container is a primary shroud. The primary container and the primary remains are positioned in a generally horizontal orientation in the lower region of the grave site in closely space proximity to the divider.

Next provided is a plurality of biodegradable urns 42. Ashes 44 of a single remains are in each urn. The urns are aligned in columns of multiple rows in the upper region. The urns are in a common horizontal plane closer to the ground level than to the divider.

Lastly, a tree 48 may be optionally provided. The tree is optionally planted on the grave site with its roots within the upper region reaching grave sites below.

Note now the alternate embodiment of the invention as illustrated in FIG. 3. In the system 100 of this alternate embodiment, the one additional biodegradable container in the upper region is a second shroud 104 encompassing a remains. The second shroud is fabricated of biodegradable fabric. The second shroud is closer to the divider than to ground level. In this alternate embodiment, the system further includes a second divider 106 and a second electronic information assembly 108 between the second divider and the second shroud. Finally, in this alternate embodiment, the system further includes an operator controlled detector 110 adapted to convert the chip from a passive quiescent state to an active disseminating state for allowing a user to read and display the digital location and contents information.

Figure 4:
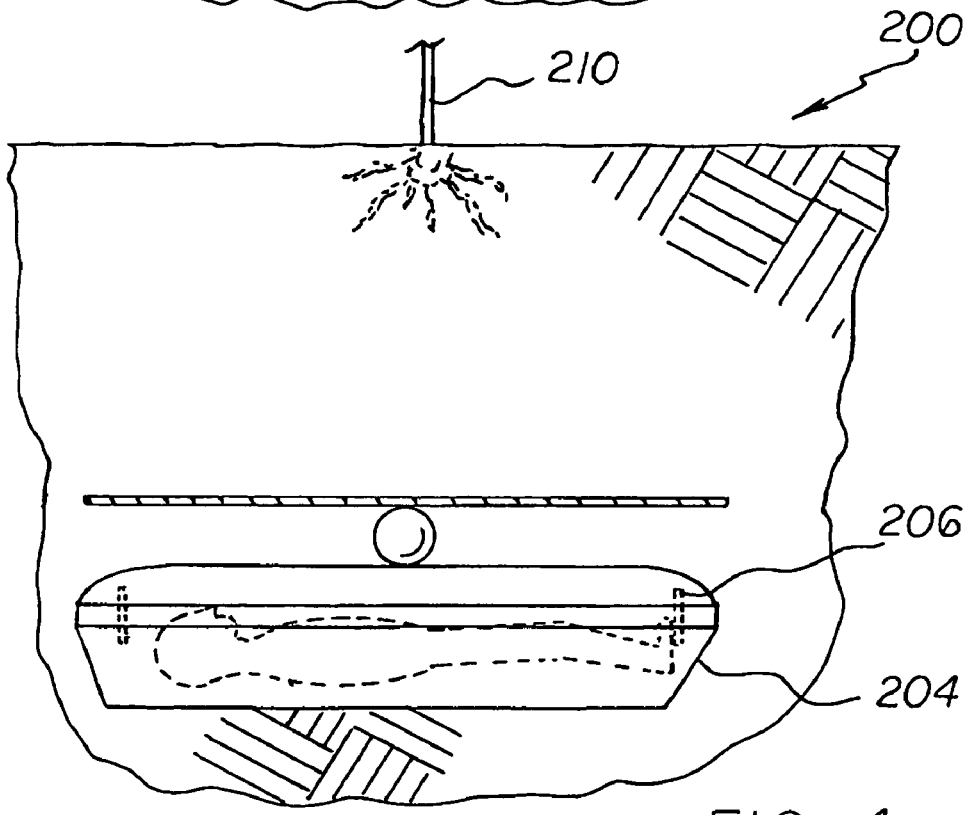

Note now the additional alternate embodiment of the invention as illustrated in FIG. 4. In this system 200 of this embodiment, the biodegradable container in the lower region of the grave site is a casket 204 of all biodegradable construction, including for example, wooden pegs 206. In this alternate embodiment, the upper region is devoid of a biodegradable container encompassing a remains in anticipation of an additional biodegradable container or containers with remains and or ashes. Additionally, a tree 210 may be planted on the grave site with the roots above the second divider.

As to the manner of usage and operation of the present invention, the same should be apparent from the above description. Accordingly, no further discussion relating to the manner of usage and operation will be provided.

Green burial is the natural remedy to assist and facilitate the return of the deceased back into the Earth without the need for embalming. The use of a casket and/or embalming are not required by law, nor are they a requirement of the cemetery when direct Green Burial is your choice. With each Green Burial an underground electronic marker is utilized. This allows for two-way communication with a hand-held receiver assuring record keeping accuracy.

Private family viewing and formal ceremonies are available upon request for those wishing to offer their final respects.

Burial garments such as a favorite pair of pajamas, a favorite dress or suit, military uniform, and/or a favorite blanket may be placed directly into the Earth. Biodegradable caskets are another dignifying option.

Additional services in conjunction with a Green Burial space entitle the owner to transfer from place of death filing and securing all necessary documents with local registrar, refrigeration, grave space, opening and closing, and perpetual care.

Memorial trees may be planted above the Green Burial site when the top space, or upper region, is purchased. Also, this upper region may accommodate up to 10 cremated remains or one additional biodegradable container encompassing a second remains.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A green burial system comprising:

a single grave site having upper and lower regions with a divider between the regions;

a biodegradable primary container encompassing a primary remains of a deceased in the lower region in closely spaced proximity to the divider;

an electronic information assembly in the grave site adjacent to the divider adapted for accurate readings even following a shift of the earth, the electronic information assembly including a non-biodegradable component including an electronic chip, the chip having digital information pertaining to the location of the grave site and the contents of the grave site, the component being positioned adjacent to the biodegradable primary container and primary remains;

an operator controlled detector adapted to convert the chip from a passive quiescent state to an active disseminating state for allowing a user to read and display the location and contents information; and the upper region adapted to receive at least one additional biodegradable container.

2. The system as set forth in claim 1 and further including:

a tree planted on the grave site with roots within the upper region.

3. The system as set forth in claim 1 wherein the biodegradable Primary container is a casket.

4. A green burial system comprising:

a single grave site having upper and lower regions with a divider between the regions;

a biodegradable primary container encompassing a primary remains of a deceased in the lower region in closely spaced proximity to the divider;

an electronic information assembly in the grave site adjacent to the divider including a non-biodegradable sphere with a hollow interior, the hollow interior including a liquid and an electronic chip, the chip having digital information pertaining to the location of the grave site and the contents of the grave site, the sphere being positioned adjacent to the lower region closely spaced from the divider.

5. The system as set forth in claim 4 and further including:

an operator controlled detector adapted to convert the chip from a passive quiescent state to an active disseminating state for allowing a user to read and display the location and contents information.

6. A green burial system comprising:

a single grave site having upper and lower regions with a divider between the regions;

a biodegradable primary container encompassing a primary remains of a deceased in the lower region in closely spaced proximity to the divider;

an electronic information assembly in the grave site adjacent to the divider;

the upper region adapted to receive at least one additional biodegradable container;

the one additional biodegradable container in the upper region consisting of a second shroud encompassing a secondary remains of a deceased, the second shroud being fabricated of biodegradable fabric and being closer to the divider than to ground level;

the system further includes a second divider and a second electronic information assembly between the second divider and the second shroud; and the system further includes a tree planted on the grave site with roots above the second shroud.

7. A burial system comprising:

a grave site;

a container encompassing remains of a deceased in the grave site; and an electronic information assembly including a non-biodegradable component including an electronic chip, the chip having digital information pertaining to the location of the grave site and the contents of the grave site, the component being positioned adjacent to the container and remains, an operator controlled detector adapted to convert the chip from a passive quiescent state to an active disseminating state for allowing a user to read and display the location and contents information.

8. A green burial system for burying plural remains in a single grave site, the burying being done in an ecological, respectful and economic manner, the system comprising:

a single grave site having dirt and including an upper region and a lower region with a non-biodegradable divider between the upper and lower regions, the grave site having a generally horizontal ground level above with the divider being generally horizontal at approximately 6 feet below ground level;

an electronic information assembly including a non-biodegradable sphere with a hollow interior, the hollow interior including water and an electronic chip, the chip having digital information pertaining to the location of the grave site and the contents of the grave site, the chip having a specific density less than that of water whereby the chip will float on the water and remain horizontal at all times for more accurate readings even following a shift of the earth, the sphere being positioned adjacent to the lower region closely spaced from the divider, an operator controlled detector adapted to convert the chip from a passive quiescent state to an active disseminating state for allowing a user to read and display the location and contents information;

a biodegradable primary container encompassing a primary remains of a deceased, the primary container being a primary shroud, the primary container and primary remains being positioned in a generally horizontal orientation in the lower region of the grave site in closely space proximity to the divider;

a plurality of biodegradable urns with ashes of a single remains of a deceased in each urn, the urns being aligned in columns of multiple rows in the upper region, the urns being in a common horizontal plane closer to the ground level than to the divider; and a tree planted on the grave site with roots within the upper region and reaching one end of the urns.

* * * * *